US009142367B2

(12) United States Patent
Dai

(10) Patent No.: US 9,142,367 B2
(45) Date of Patent: Sep. 22, 2015

(54) ELECTRONIC DEVICE AND POWER BUTTON MODULE THEREOF

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Bin Dai, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 300 days.

(21) Appl. No.: 13/900,643

(22) Filed: May 23, 2013

(65) Prior Publication Data

US 2014/0014481 A1 Jan. 16, 2014

(30) Foreign Application Priority Data

Jul. 16, 2012 (CN) ..... 2012 1 0244967

(51) Int. Cl.
*H01H 1/30* (2006.01)
*H01H 13/10* (2006.01)

(52) U.S. Cl.
CPC ..... *H01H 13/10* (2013.01)

(58) Field of Classification Search
CPC ..... H01H 1/30; H01H 1/245; H01H 1/24; H01H 13/10; H01H 13/52
USPC ..... 200/245, 247–345, 537–552
See application file for complete search history.

(56) References Cited

U.S. PATENT DOCUMENTS

| | | | | |
|---|---|---|---|---|
| 6,667,447 | B2 * | 12/2003 | Liu et al. | 200/5 R |
| 7,189,932 | B2 * | 3/2007 | Kim | 200/5 R |
| 7,511,235 | B2 * | 3/2009 | Osada | 200/6 A |
| 8,093,522 | B2 * | 1/2012 | Cheng | 200/341 |
| 8,253,051 | B2 * | 8/2012 | Dai | 200/345 |
| 2009/0059485 | A1 * | 3/2009 | Lynch et al. | 361/679.01 |

* cited by examiner

*Primary Examiner* — Briggitte R Hammond
*Assistant Examiner* — Doblade Elliott
(74) *Attorney, Agent, or Firm* — Novak Druce Connolly Bove + Quigg LLP

(57) ABSTRACT

A power button module includes a pressing member, a printed circuited board, a supporting member and a bottom cover. The supporting member defines a receiving hole therein and includes a mounting portion. The mounting portion includes a base body, a mounting section and a plurality of resilient arms interconnecting the base body and the mounting section, the pressing member is partially received in the receiving hole and fixed to the mounting section, the printed circuit board partially extends through the mounting section and connects with the pressing member. The printed circuit board comprises a contacting portion away from the pressing member. The bottom cover is fixed to the supporting member and receives the mounting portion. The bottom cover comprises an electrical connecting portion spaced from the contacting portion. The present invention further discloses an electronic device using the power button module.

20 Claims, 5 Drawing Sheets

ELECTRONIC DEVICE AND POWER BUTTON MODULE THEREOF

BACKGROUND

1. Technical Field

The present disclosure relates to an electronic device and a power button module thereof.

2. Description of Related Art

Electronic device usually employs an electrical power button module to switch on/off the electronic device. The power button module of the electronic device includes a pressing member, a supporting member, a printed circuit board assembled on the supporting member, and a resilient clip positioned between the printed circuit board and the pressing member. When assembling the power button module, the pressing member extends through an opening on a housing of the electronic device, and the resilient clip is assembled on the pressing member. The supporting member is fixed to the housing of the electronic device and resists the resilient clip toward the pressing member. The printed circuit board is located between the resilient clip and the supporting member. However, during the assembly process of the power button module of the electronic device, manual labor is applied to press the pressing member and the resilient member, thereby assembling the supporting member to clamp the pressing member on the electronic device. Thus a high degree of assembly precision of the resilient clip is difficult to achieve, and the power button module assembly is labor-consuming.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
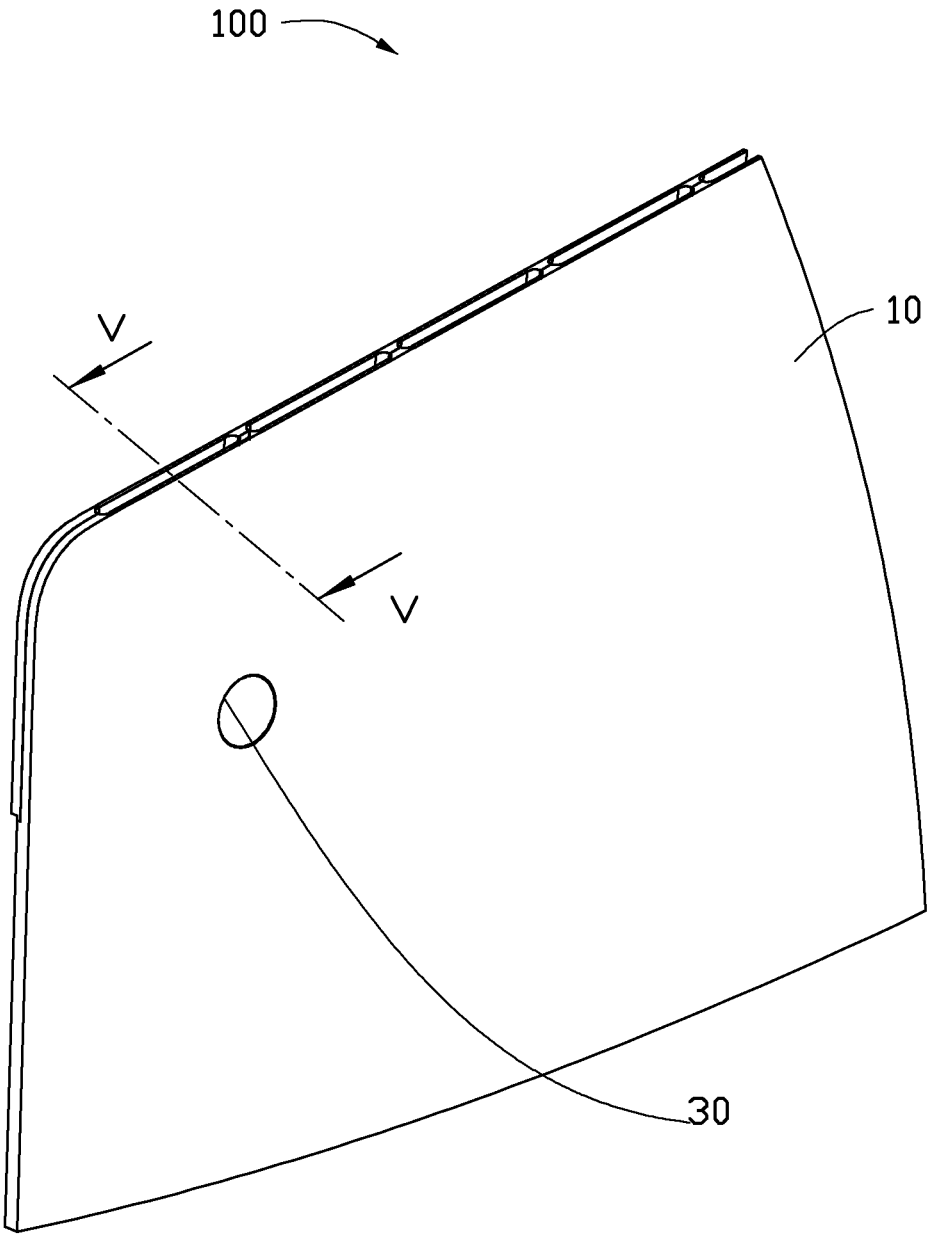
FIG. 1 is an isometric view of an embodiment of a part of an electronic device.
Figure 2:
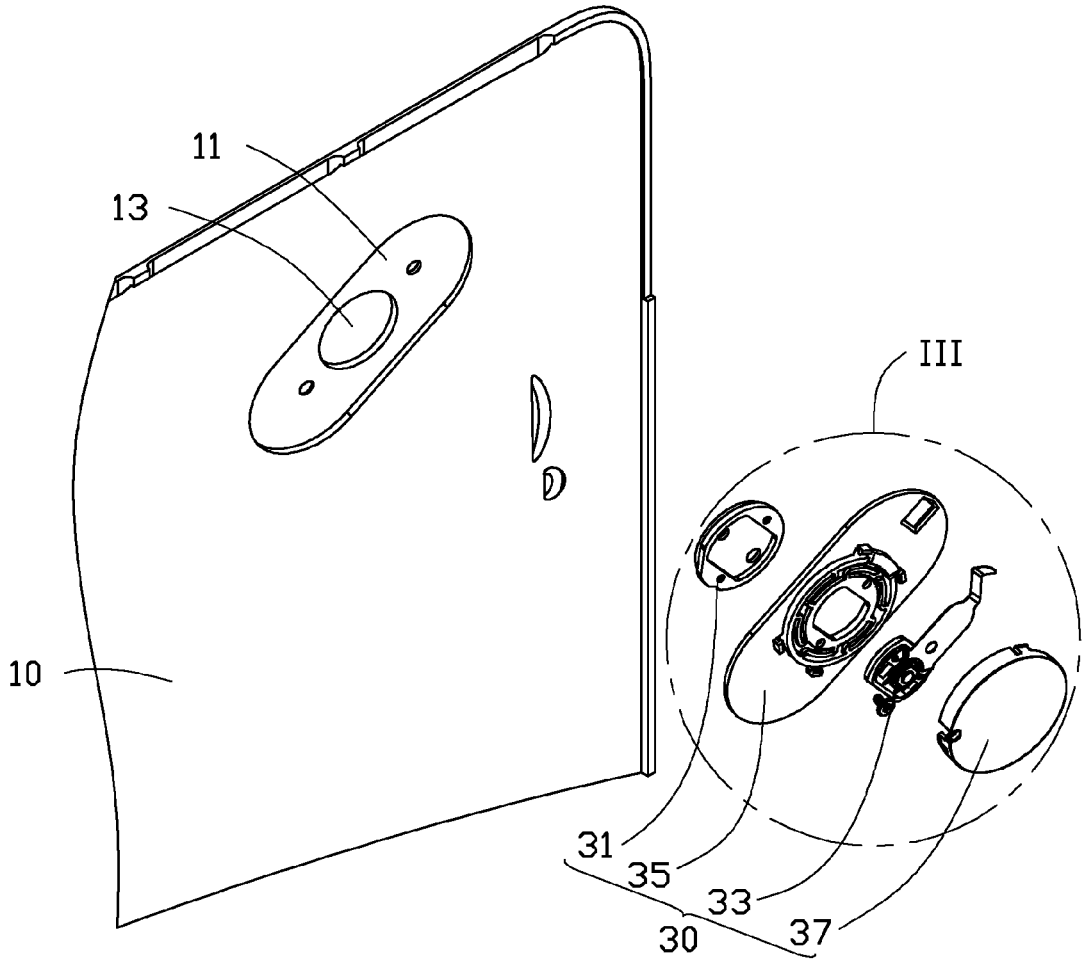
FIG. 2 is an exploded, isometric view of the part of the electronic device of FIG. 1.

FIGS. 1 and 2 show an embodiment of electronic device 100. The electronic device includes a housing 10, an (electrical) power button module 30 assembled on the electronic device 100. The housing 10 defines a receiving depression 11 and a mounting hole 13 on a bottom of the receiving depression 11. In the illustrated embodiment, the receiving depression 11 is substantially strip shape, but the receiving depression 11 may be in other shape, such as square shape.

Figure 3:
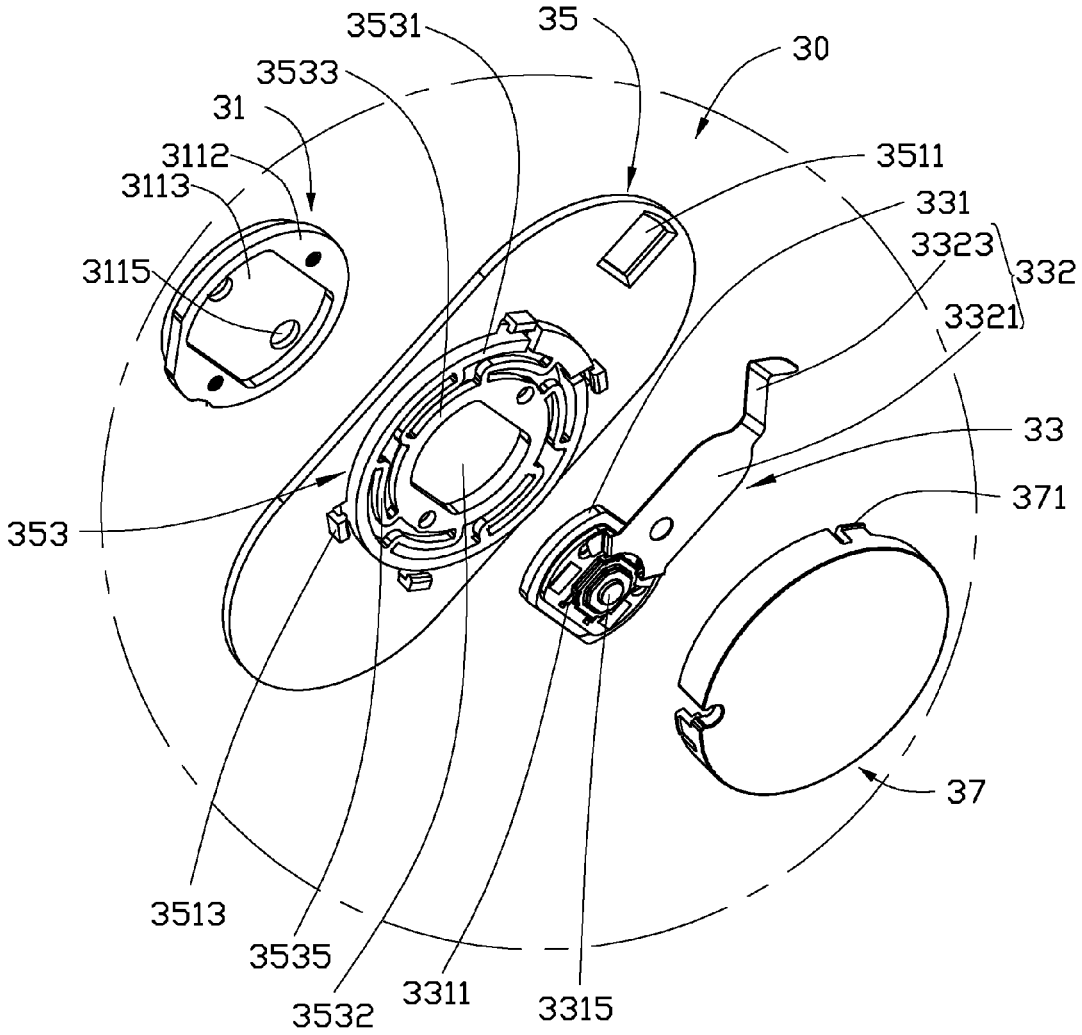
FIG. 3 is an enlarged view of a circled portion III of FIG. 2.
Figure 4:
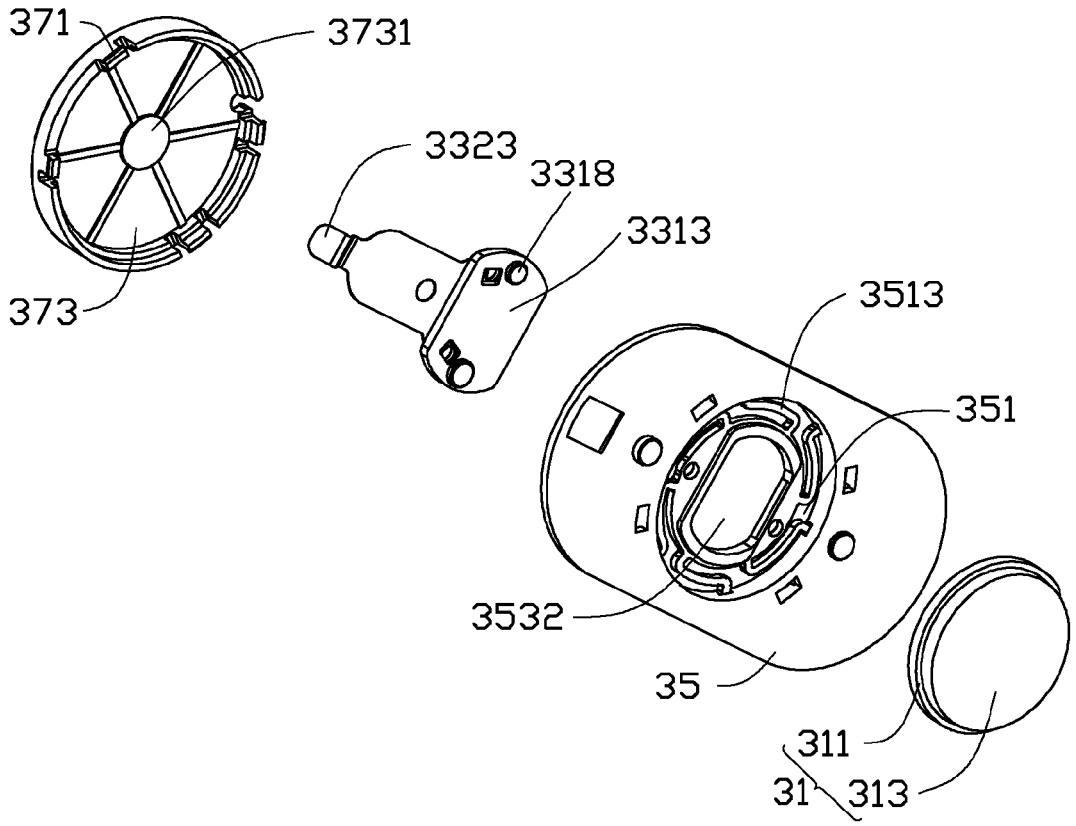
FIG. 4 is similar to FIG. 3, viewed from another aspect.
Figure 5:
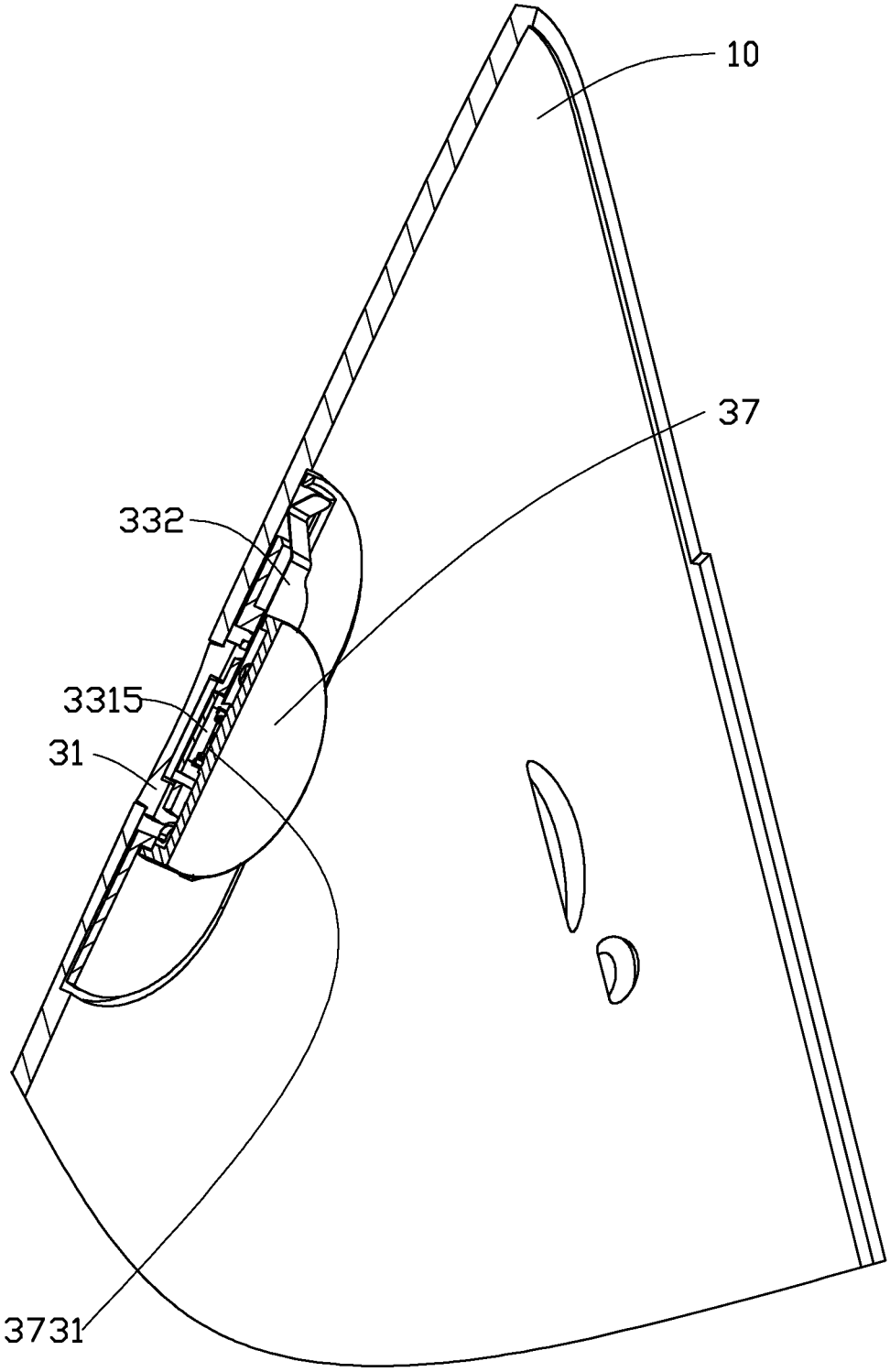
FIG. 5 is a cross-sectional view of the part of the electronic device of FIG. 1 taken along line V-V.

FIGS. 3 and 5 show that the power button module 30 includes a pressing member 31, a printed circuit board 33, a supporting member 35 and a bottom cover 37. The pressing member 31 includes a connecting portion 311 and a pressing portion 313 on the connecting portion 311. The connecting portion 311 is received in the receiving depression 11, and the pressing portion 313 extends through the mounting hole 13. The connecting portion 311 includes a combing surface 3112, and defines a mounting groove 3113 on the combing surface 3112 and a pair of combing grooves 3115 on a bottom of the mounting groove 3113.

The printed circuit board 33 is connected to the connecting portion 311 of the pressing member 31. The printed circuited board 33 includes a main body 331 and a resilient ground clip 332 extending from a side of the main body 331. The main body 331 includes a first surface 3311 and a second surface 3313 opposite to the first surface 3311. The main body 331 further includes a contacting portion 3315 disposed on a central region of the first surface 3311 and a pair of electrical protrusions 3318 on the second surface 3313. The main body 331 is partially received in the mounting groove 3113, and is adhered or bonded to the pressing member 31 by glue. The pair of electrical protrusions 3318 is respectively received in the pair of combing grooves 3115. The printed circuit board 33 may be combined or attached to the pressing member 31 by means of other structure, such as latching structure, or bolt. The resilient ground clip 332 includes a fixing portion 3321 and a resisting portion 3323 bent from an end of the fixing portion 3321. The fixing portion 3321 is fixed to the first surface 3311, and located adjacent to the contacting portion 3315. The resisting portion 3323 is substantially V shaped, and resists the housing 10.

The supporting member 35 has a shape similar to the receiving depression 11, and is received in the receiving depression 11. The supporting member 35 is located between the pressing member 31 and the printed circuit board 33. The supporting member 35 defines a though hole 3511 on a side portion, and a receiving hole 351 on a central portion thereof. The supporting member 35 further includes a mounting portion 353 surrounding the receiving hole 351 and a plurality of latching arms 3513 at a periphery of the mounting portion 353. The mounting portion 353 includes a base body 3531, a mounting section 3533 and a plurality of resilient arms 3535 interconnecting the base body 3531 and the mounting section 3533. The base body 3531 is substantially in a ring shape, and extends from a periphery of the receiving hole 351 and located at a side of the supporting member 35 opposite to the pressing member 31. The base body 3531 is coaxial with the receiving hole 351. The mounting section 3533 is substantially in a ring shape, and received in the base body 3531. The mounting section 3533 is coaxial with the base body 3531, and located at an end of the receiving hole 351. The mounting section 3533 defines an opening 3532 thereon communicating with the receiving hole 351. The connecting portion 311 of the pressing member 31 is received in the receiving hole 351, and fixed to the mounting section 3533. The main body 331 of the printed circuit board 33 extends through the opening 3532, and the resisting portion 3323 of the resilient ground clip 332 extends through the through hole 3511. The plurality of resilient arms 3535 extend curvedly between the base body 3531 and the mounting section 3533 to provide an elastic force to reposition the printed circuit board 33. The plurality of resilient arms 3535 are arranged around the mounting section 3533, and spaced from each other uniformly. In the illustrated embodiment, the plurality of resilient arms 3535 includes six resilient arms 3535. The plurality of latching arms 3513 are arranged around the base body 3531, and substantially in an L shape.

The bottom cover 37 is assembled on the supporting member 35 and covers the mounting portion 353. The bottom cover 37 is substantially disc-shape, and defines a containing groove 373 in a central portion thereof for receiving the mounting portion 353 of the supporting member 35. The bottom cover 37 further includes an electrical connecting portion 3731 in a central portion at a bottom of the containing groove 373 and a plurality of hooks 371 surrounding the containing groove 373. The plurality of hooks 371 latch with the plurality of latching arms 3513 respectively. The electrical connecting portion 3731 contacts with the contacting portion 3315, and finally connects with the pair of electrical protrusions 3318 electrically.

When assembling the electronic device 100, the connecting portion 311 of the pressing member 31 is received in the receiving hole 351 and fixed to the supporting member 35. The main body 331 of the printed circuit board 33 is received in the opening 3532 of the supporting member 35. The pair of electrical protrusions 3318 is respectively received in the pair of combing grooves 3115 of the pressing member 31. The resisting portion 3323 of the resilient ground clip 332 extends through the through hole 3511. The bottom cover 37 is assembled to the supporting member 35, and covers the mounting portion 353. The supporting member 35 is received in the receiving depression 11 and fixed to the housing 10. The pressing member 31 is slidably received in mounting hole 13, and the resisting portion 3323 of the resilient ground clip 332 resists the housing 10.

When in use, a force is applied to the pressing member 31, the plurality of resilient arms 3535 is deformed from the original or relaxed state, the connecting portion 311 and the mounting section 3533 of the mounting portion 353 moves toward the printed circuit board 33, and resist the main body 331 of the printed circuit board 33 toward the bottom cover 37. Therefore, the contacting portion 3315 of the main body 331 electrically contacts with the electrical connecting portion 3731 of the bottom cover 37, such that an internal circuit of the electronic device 100 is toggled and the electronic device 100 is turned on. When the pressing member 31 is released, the plurality of resilient arms 3535 rebounds back to original or relaxed state, and the connecting portion 311 of the pressing member 31 and the mounting section 3533 of the supporting member 35 resist by the plurality of resilient arms 3535 to go back to original position. When the pressing member 31 is pressed again, the electronic device 100 is turned off.

The main body 331 of the printed circuit board 33 is fixed to the mounting portion 353 of the supporting member 35, and the plurality of resilient arms 3535 of the mounting portion 353 provides a maintaining force for the pressing member 31 and the printed circuit board 33. Because the plurality of resilient arms 3535 is formed on the mounting portion 353, such that an assembly of resilient clips is thereby omitted, and the assembly precision of the power button module 30 is relative high. A manufacturing assembling productivity of the electronic device 100 is higher.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A power button module for an electronic device, comprising:

a pressing member;

a printed circuit board;

a supporting member located between the pressing member and the printed circuit board, wherein the supporting member defines a receiving hole thereon and comprises a mounting portion surrounding the receiving hole, the mounting portion comprises a base body, a mounting section and a plurality of resilient arms interconnecting the base body and the mounting section, the mounting section is received in the base body and located at an end of the receiving hole, the pressing member is partially received in the receiving hole and fixed to the mounting section, the printed circuit board partially extends through the mounting section and connects with the pressing member, the printed circuit board comprises a contacting portion away from the pressing member; and a bottom cover fixed to the supporting member and receiving the mounting portion, the bottom cover comprising an electrical connecting portion spaced from the contacting portion of the printed circuit board;

wherein when the pressing member is pressed toward the bottom cover, the contacting portion is resisted to contact with the electrical connecting portion, the plurality of the resilient arms are deformed and providing a maintaining force to enable the pressing member to rebound back to original state.

2. The power button module of claim 1, wherein the mounting portion comprises a plurality of latching arms at a periphery thereof, the bottom cover comprises a plurality of hooks at a periphery thereof, the plurality of hooks latch with the plurality of latching arms respectively to fix the bottom cover to the supporting member.

3. The power button module of claim 2, wherein the bottom cover defines a containing groove thereon, the plurality of hooks are arranged around the containing groove, the electrical connecting portion is located at a central portion of a bottom of the containing groove, the mounting portion of the supporting member and the contacting portion of the printed circuit board are received in the containing groove.

4. The power button module of claim 1, wherein the pressing member comprises a connecting portion and a pressing portion on the connecting portion, the printed circuit board comprises a main body, the contacting portion is formed on the main body, the mounting section of the supporting member defines an opening thereon communicating with the receiving hole, the main body is received in the opening and fixed to the connecting portion of the pressing member.

5. The power button module of claim 4, wherein the connecting portion comprises a combing surface, and defines a mounting groove on the combing surface and a pair of combing grooves on a bottom of the mounting groove, the main body of the printed circuit board comprises a pair of electrical protrusions located at opposite surface to the contacting portion, the pair of electrical protrusions are respectively received in the pair of combing grooves.

6. The power button module of claim 5, wherein the receiving hole is defined in a central portion of the supporting member, the supporting member further defines a though hole on a side portion thereof, the printed circuit board further comprises a resilient ground clip extending from a side of the main body, the resilient ground clip comprises a fixing portion and a resisting portion bent from an end of the fixing portion, the fixing portion is fixed to the main body adjacent to the contacting portion, the resisting portion extends through the through hole of the supporting member.

7. The power button module of claim 1, wherein the base body is coaxial with the receiving hole, the mounting section is coaxial with the base body, the plurality of resilient arms extend curvedly between the base body and the mounting section, the plurality of resilient arms are arranged around the mounting section, and spaced from each other uniformly.

8. A power button module for an electronic device, comprising:

a pressing member comprising a connecting portion and a pressing portion on the connecting portion;

a printed circuit board comprising a main body;

a supporting member defining a receiving hole thereon and comprising a mounting portion surrounding the receiving hole, wherein the mounting portion comprises an base body, a mounting section and a plurality of resilient arms interconnecting the base body and the mounting section, the mounting section is received in the base body and located at an end of the receiving hole, the connecting portion of the pressing member and the main body of the printed circuit board are located at opposite sides of the supporting member, the connecting portion of the pressing member is received in the receiving hole and fixed to the mounting section, the main body is connected to the connecting portion, the main body comprises a contacting portion away from the pressing member; and a bottom cover fixed to the supporting member, the bottom cover comprising an electrical connecting portion spaced from the contacting portion of the printed circuit board;

wherein when the pressing portion of the pressing member is pressed, the contacting portion of the printed circuit board is resisted to contact with the electrical connecting portion of the bottom cover, the plurality of the resilient arms provides a maintaining force to enable the pressing member to rebound back to original state.

9. The power button module of claim 8, wherein the mounting portion comprises a plurality of latching arms at a periphery thereof, the bottom cover comprises a plurality of hooks at a periphery thereof, the plurality of hooks latch with the plurality of latching arms respectively to fix the bottom cover to the supporting member.

10. The power button module of claim 9, wherein the bottom cover defines a containing groove thereon, the plurality of hooks are arranged around the containing groove, the electrical connecting portion is located at a central portion of a bottom of the containing groove, the mounting portion of the supporting member and the contacting portion of the printed circuit board are received in the containing groove.

11. The power button module of claim 8, wherein the connecting portion comprises a combing surface, and defines a mounting groove on the combing surface and a pair of combing grooves on a bottom of the mounting groove, the main body of the printed circuit board comprises a pair of electrical protrusions located opposite from the contacting portion, the pair of electrical protrusions are respectively received in the pair of combing grooves.

12. The power button module of claim 8, wherein the receiving hole is defined in a central portion of the supporting member, the supporting member further defines a though hole on a side portion thereof, the printed circuit board further comprises a resilient ground clip extending from a side of the main body, the resilient ground clip comprises a fixing portion and a resisting portion bent from an end of the fixing portion, the fixing portion is fixed to the main body adjacent to the contacting portion, the resisting portion extends through the through hole of the supporting member.

13. The power button module of claim 8, wherein the base body is coaxial with the receiving hole, the mounting section is coaxial with the base body and defines an opening thereon communicating with the receiving hole, the main body of the printed circuit board is received in the opening.

14. An electronic device, comprising a housing defining a mounting hole thereon; and a power button module, comprising:

a pressing member slidably received in the mounting hole of the housing;

a printed circuit board;

a supporting member located between the pressing member and the printed circuit board, wherein the supporting member defines a receiving hole therein and comprises a mounting portion surrounding the receiving hole, the mounting portion comprises an base body, a mounting section and a plurality of resilient arms interconnecting the base body and the mounting section, the mounting section is received in the base body and located at an end of the receiving hole, the pressing member is partially received in the receiving hole and fixed to the mounting section, the printed circuit board partially extends through the mounting section and connects with the pressing member, the printed circuited board comprises a contacting portion away from the pressing member; and a bottom cover fixed to the supporting member and receiving the mounting portion, the bottom cover comprising an electrical connecting portion spaced from the contacting portion of the printed circuit board;

wherein when the pressing member is pressed toward the bottom cover, the contacting portion is resisted to contact with the electrical connecting portion, the plurality of the resilient arms are deformed to provide a maintaining force to enable the pressing member to rebound back.

15. The electronic device of claim 14, wherein the mounting portion of the power button module comprises a plurality of latching arms at a periphery thereof, the bottom cover comprises a plurality of hooks at a periphery thereof, the plurality of hooks latch with the plurality of latching arms respectively to fix the bottom cover to the supporting member.

16. The electronic device of claim 15, wherein the bottom cover of the power button module defines a containing groove thereon, the plurality of latching arms are arranged around the containing groove, the electrical connecting portion is located at a central portion of a bottom of the containing groove, the mounting portion of the supporting member and the contacting portion of the printed circuit board are received in the containing groove.

17. The electronic device of claim 14, wherein the housing defines a receiving depression thereon, the mounting hole is defined on a bottom of the receiving depression, the pressing member comprises a connecting portion and a pressing portion on the connecting portion, the connecting portion is received in the receiving depression and the pressing portion extends through the mounting hole.

18. The electronic device of claim 17, wherein the printed circuit board of the power button module comprises a main body, the contacting portion is formed on the main body, the mounting section of the supporting member defines an opening thereon communicating with the receiving hole, the main body is received in the opening and fixed to the connecting portion of the pressing member.

19. The electronic device of claim 15, wherein the connecting portion of the power button module comprises a combing surface, and defines a mounting groove on the combing surface and a pair of combing groove on a bottom of the mounting groove, the main body of the printed circuit board comprises a pair of electrical protrusions located opposite from the contacting portion, the pair of electrical protrusions are respectively received in the pair of combing grooves.

20. The electronic device of claim 14, wherein the receiving hole is defined in a central portion of the supporting member, the supporting member further defines a though hole on a side portion thereof, the printed circuit board further comprises a resilient ground clip extending from a side of the printed circuit board, the resilient ground clip comprises a fixing portion and a resisting portion bent from an end of the fixing portion, the fixing portion is fixed to the printed circuit board adjacent to the contacting portion, the resisting portion extends through the through hole of the supporting member and resists the housing.

* * * * *